US005294011A

United States Patent [19]

Konrad et al.

[11] Patent Number: 5,294,011

[45] Date of Patent: Mar. 15, 1994

[54] CLOSURE MEANS FOR A CYLINDRICAL HOUSING

[75] Inventors: Franz Konrad, Regau; Günther Pakanecz; Manfred Lederer, both of Kremsmünster, all of Austria

[73] Assignee: C. A. Greiner & Sohne Gesellschaft m.b.H., Kremsmünster, Austria

[21] Appl. No.: 999,571

[22] Filed: Dec. 30, 1992

Related U.S. Application Data

[63] Continuation of Ser. No. 665,011, Mar. 5, 1991, abandoned.

[30] Foreign Application Priority Data

Mar. 9, 1990 [AT] Austria ..... A 574/90

[51] Int. Cl.[5] ..... B65D 51/18

[52] U.S. Cl. ..... 215/247; 215/274; 215/276; 215/354; 215/364

[58] Field of Search ..... 215/247, 248, 249, 274, 215/276, 354, 364

[56] References Cited

U.S. PATENT DOCUMENTS

| | | | |
|---|---|---|---|
| 3,017,050 | 1/1962 | Ball, Sr. et al. | 215/247 |
| 3,499,568 | 3/1970 | Vinas Riera | 215/276 |
| 3,709,395 | 1/1973 | Brennan et al. | 215/247 |
| 4,089,432 | 5/1978 | Crankshaw et al. | 215/6 |
| 4,176,756 | 12/1979 | Gellman | 215/274 |
| 4,205,754 | 6/1980 | Nielsen et al. | 215/249 |
| 4,331,233 | 5/1982 | Braymer, Jr. | 206/221 |
| 4,366,912 | 1/1983 | Matukura et al. | 215/247 |
| 4,465,200 | 8/1984 | Percarpio | 215/247 |
| 4,531,651 | 7/1985 | Donnelly | 215/354 |
| 4,635,807 | 1/1987 | Knapp | 215/247 |
| 4,652,429 | 3/1987 | Konrad | 422/102 |
| 4,756,974 | 7/1988 | Romberg | 215/364 X |

FOREIGN PATENT DOCUMENTS

| | | |
|---|---|---|
| 379069 | 11/1985 | Austria . |
| 0129029 | 12/1984 | European Pat. Off. . |
| 0257498 | 3/1988 | European Pat. Off. . |
| WO89/09735 | 10/1989 | PCT Int'l Appl. . |

*Primary Examiner*—Allan N. Shoap
*Assistant Examiner*—Nova Stucker
*Attorney, Agent, or Firm*—Collard & Roe

[57] ABSTRACT

The open end of a cylindrical housing which may be an evacuable housing, for example a tube for storing blood samples, is closed by means of a cap having an annular wall surrounding the open end of the housing and a seal extending into the cap and the housing. For secure sealing of the housing, the cap is connected by means of a coupling device either to the seal or to the housing or both of these.

13 Claims, 2 Drawing Sheets

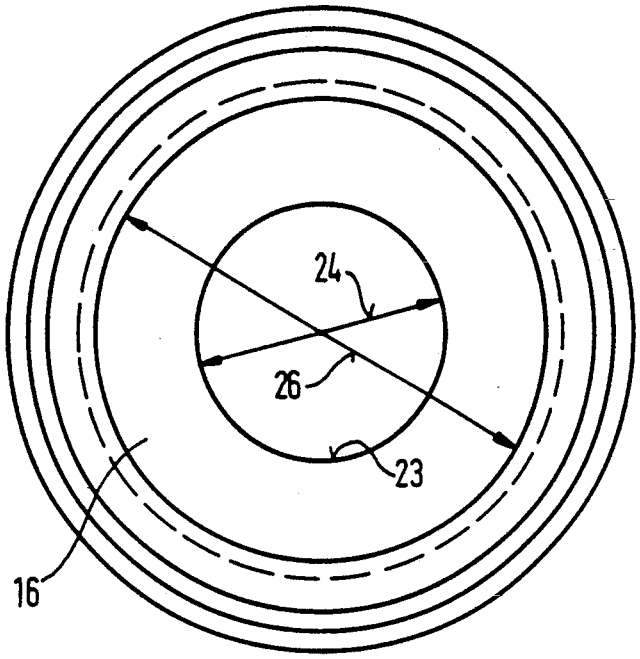
Fig. 2
Fig. 4
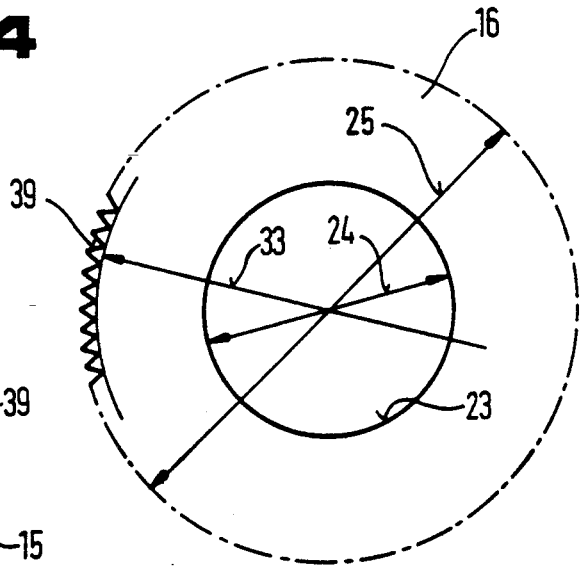
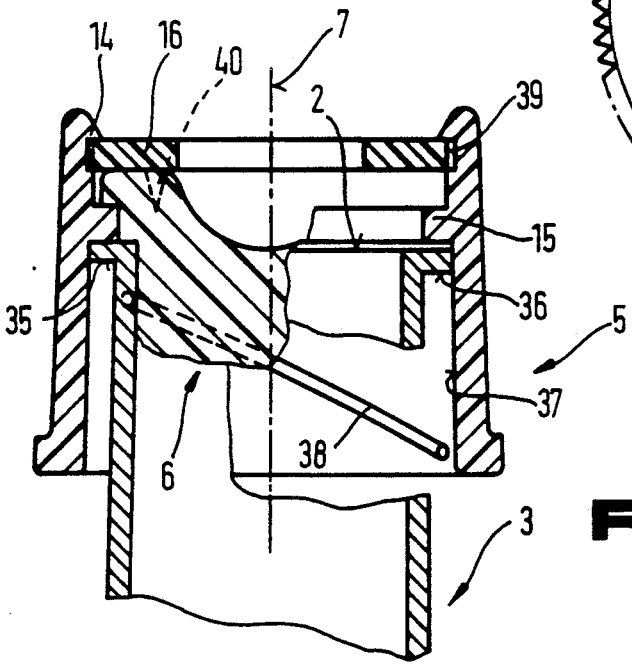
Fig. 3

CLOSURE MEANS FOR A CYLINDRICAL HOUSING

This is a continuation of copending application(s) Ser. No. 07/665,011 filed on Mar. 5, 1991, abandoned.

FIELD OF THE INVENTION

The invention relates to closure means for closing the open end face of a cylindrical housing, in particular an evacuable housing, the closure means comprising a cap having a wall surrounding the end face of the cylindrical housing, and defining a bore, a seal extending into the bore and the interior of the housing.

BACKGROUND OF THE INVENTION

Such closure means for a cylindrical housing, in particular a blood sample tube, is disclosed in AT-A-379 069. This closure means comprises a cap surrounding an open end face of the cylindrical housing and defining a bore, a seal being provided in the bore and the interior of the housing. In the bore or in a tubular extension adjoining the bore, there are provided projections which protrude over the surface of the cap, the projections being covered by the seal. It cannot always be ensured, however, that the closure means can be opened without allowing the escape of medicaments or body fluids that may be contained in the cylindrical housing, in dependence upon the adhesion between the seal and the housing.

Also, closure means for cylindrical housings, in particular for medicaments or body fluids, are known, which comprise a one piece cap or a cap made up of several pieces, for use with a seal. For example, U.S. application Ser. No. 4 465 200, U.S. application Ser. No. 4 205 754, U.S. application Ser. No. 4 089 432, EP-B-129 029 and EP-A-257 498 concern the closure of an open end face of a cylindrical housing by means of a plug like seal secured in the housing by means of a cap. In such closure means very substantial force must be applied longitudinally of the cylindrical housing, in order to overcome the adhesion between the seal and the housing, so that the contents, for example, medicaments or body fluids stored in the housing, may escape and thus give rise to burns or infection. Such escape is especially disadvantageous in the processing of blood infected with AIDS. Also when the seal is pierced with a needle to remove a sample of the contents of the cylindrical housing, the closure means may be inadvertently opened.

SUMMARY OF THE INVENTION

The present invention is intended to provide closure means for a cylindrical housing, in particular a blood sample tube, providing secure, gas-tight closure of the interior of the cylindrical housing even over a lengthy period of storage, and which closure means effectively prevents relative movement between the closure means and the housing in the longitudinal direction thereof.

According to the present invention the cap is connected by way of a coupling device to the seal and/or to the cylindrical housing. By these apparently simple measures, permanent, airtight closure of a blood sample tube can be achieved, reliable sealing between tube and the seal being maintained where the seal is pierced with a needle in order to extract a sample of blood.

The coupling device may comprise at least one first coupling piece, movably connected to the cap, and a second coupling piece associated therewith and being movably connected to the seal, and preferably being provided with arresting extensions for restraining twisting and/or displacement of the seal in the longitudinal direction of the cylindrical housing. The seal can accordingly withstand an axial load, such as could arise where the seal is pierced by means of a needle of large diameter. The fluid stored in the tube can then be removed from the tube, for example by suction, without the closure means having to be opened.

Said second coupling piece which preferably provides an arresting extension, may be in the form of a flange, which overhangs a cylindrical sealing face of the seal in the region of an end face of the seal, approximately to the extent of the wall thickness of the cylindrical housing. The internal diameter of the wall of the cap can thereby correspond approximately to the external diameter of the cylindrical housing, so that the cap is effectively guided during opening or closing movement of the cap.

The coupling pieces of the cap, may be formed as extensions thereof which project over the cylindrical internal surface of the cap towards a longitudinal axis thereof and to define a groove retaining therein the coupling piece of the seal, which is in the form of said flange. The seal can thereby be retained in the cap so that the great axial force resulting from the withdrawal of the seal from the cylindrical housing, does not necessitate the provision of further securing means for the seal, in the cap.

A retaining ring, which may be for example in the form of a washer or a clamping ring, may be associated with said coupling pieces, and may be arranged between the seal and said arresting extension, which may be, for example, a holding nose or an annular flange, projecting towards the longitudinal axis of the cap over the bore defined by the annular wall of the cap at the end thereof remote from the cylindrical housing. The seal can thereby be simply and effectively mounted in the cap and be securely fixed in the axial direction of the cap.

The diameter of the opening defined by the retaining ring may be smaller than an external diameter of the seal in the region of said coupling piece of the seal, the diameter of said opening preferably being smaller than the internal diameter of the cylindrical housing. When a needle is withdrawn from the seal the seal cannot, therefore, be withdrawn through the opening in the retaining ring.

The internal diameter of the arresting extension, which may be a circular support ring, may be smaller than an external diameter of the retaining ring. The retaining ring, can, therefore, after being pressed through said extension, resile elastically and snap behind the said extension, whereby no mechanical attachment procedures are needed in order to secure the seal in the cap.

The said wall of the cap may be in the form of a frusto-conical shell, tapering towards the said extensions. The internal diameter of said wall, is, between the said extensions, preferably smaller than the external diameter of the retaining ring, whereby upon insertion of the retaining ring, the cap is prestressed in the direction of the housing so that the closure means is even more securely seated on the housing.

The retaining ring may be provided with an arresting element projecting in the direction of the cap, so that the seal cannot twist with respect to the retaining ring.

The circumference of the retaining ring may be provided with arresting elements, in order to prevent the seal from twisting with respect to the cap.

The thickness of the flange of the seal is preferably greater than a distance between the two extensions of the cap, in the direction of the longitudinal axis thereof, less the thickness of the retaining ring. The retaining ring is thereby pressed against supporting faces of said extensions of the cap by virtue of the elasticity of the flange of the seal and is thus secured against axial displacement.

The seal may be made from a composite material, the seal preferably comprising a highly elastic internal core surrounded by an annular sheath of greater rigidity than said core. By virtue of the elasticity of said core the seal retains its sealing properties after it has been pierced in order to extract a sample of the contents of the cylindrical housing. At the same time, the harder sheathing of the seal improves the retention of the flange of the seal between said arresting extensions of the cap, so that the seal is secured very firmly against both axial and radial movement.

Said core of the seal has a hardness of preferably 43° Shore, the said sheath, in particular at the flanges of the seal being of greater hardness.

BRIEF DESCRIPTION OF THE DRAWINGS

FIG. 2 is a plan view of the closure means shown in FIG. 1;

FIG. 3 is an enlarged, partly diagrammatic axial sectional view of a second embodiment of closure means for a cylindrical housing, when assembled thereto, the housing being shown in fragmentary form; and FIG. 4 is a plan view of a retaining ring of the closure means shown in FIG. 3.

DETAILED DESCRIPTION OF THE INVENTION

Figure 1:
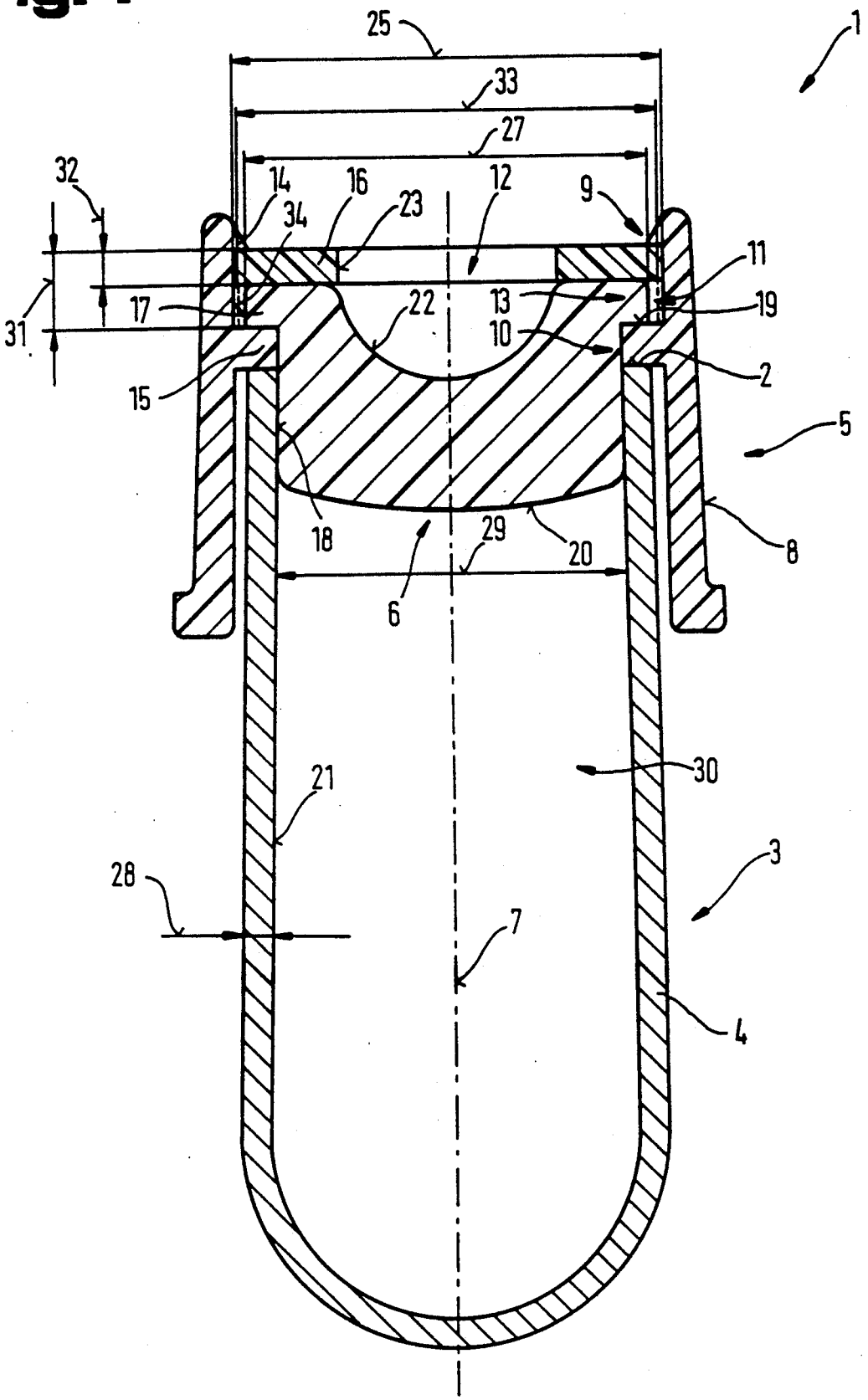
FIG. 1 is an enlarged partly diagrammatic axial sectional view of a first embodiment of closure means for a cylindrical housing, when assembled thereto.

The first embodiment of the invention will now be described with reference to FIGS. 1 and 2.

FIGS. 1 and 2, show a closure means 1 for closing an open end face 2 of a cylindrical housing 3. The housing 3 may be, for example, a blood sample tube 4. For closing said end face 2, the closure means 1 comprises an annular cap 5 surrounding the end face 2, and a seal 6. The cap 5 is concentric with the longitudinal axis 7 of the housing 3 and comprises an annular shell 8.

Coupling pieces 9, 10, 11 and 12 which together constitutes a coupling device 13 consist respectively, of extensions 14 and 15 of the shell 8, a flange form projection 17 of the seal 6 and a retaining ring 16. The seal is in the form of a sealing plug having a circular sealing face 18 and sealing faces 19 and 20 extending transversely of the longitudinal axis 7. The sealing face 18 cooperates with an internal contact face 21 of the housing 3.

The sealing device 6 has a central depression 22 in its side facing the retaining ring 16. The depression 22, which has a diameter 24 (FIG. 2) is of approximately the same cross-sectional area as an opening 23 in the ring 16. The projection 17 which constitutes the coupling piece 11, and is in the form of a flange, extends over the sealing face 18 of the seal 6 and is secured between the extensions 14 and 15, which lie in respective planes which are spaced from each other in the direction of the longitudinal axis 7 and also transversely thereof. The extensions 14 and 15 are, as shown, annular circular projections. For securing the seal 6 in the cap 5, the retaining ring 16 is interposed between the seal 6 and the extension 14. The ring 16 has a greater external diameter 25, than an internal diameter 26 (FIG. 2) of the extension 14. Likewise, the diameter 24 of the opening 23 of the ring 16 is smaller than an external diameter 27 of the seal 6. The external diameter 27 of the seal 6 is, however, dimensioned so as to be greater at least by twice the wall thickness 28 of the housing 3, than the internal diameter 29 of the interior 30 of the housing 3. Since the extension 15, which constitutes the coupling piece 10, has an internal diameter which corresponds substantially to the internal diameter 29 of the housing 3, an excellent seal is produced between the interior 30 of the housing 3 and the atmosphere surrounding it.

The external diameter of the sealing face 18 was, before the insertion of the seal 6 into the housing 3, greater than the internal diameter 29 of the housing 3, the height of the projection 17 in the direction of the longitudinal axis 7 then being greater than the height 31 of the groove defined between the extensions 14 and 15, less the thickness 32 of the retaining ring 16.

When assembling the closure means 1, the seal 6 is first advanced past the extension 14, which has a greater internal diameter 26 (FIG. 2) than the external diameter 27 of seal 6, to engage the extension 15, the diameter of which corresponds approximately to the internal diameter 29 of the housing 3.

The retaining ring 16 is then pressed through the opening defined by the extension 14, being resiliently compressed until it resiles after having passed through said opening and so is prevented from escaping from the caps.

As described above, if the height of the projection 17 is greater than the height 31 of the groove defined between the two extension 14 and 15 less the thickness 32 of the retaining ring 16, the seal 6 is compressed and prestressed so that the retaining ring 16 is firmly seated and lies closely against the end face of the extension 14, facing the extension 15.

The cap shell 8 may be constructed as a truncated cylindrical shell, or as a frusto-conical shell which is of smaller diameter in the region of the extension 14 than in the region of its end facing the housing 3. If the external diameter 25 of the ring 16 is slightly greater than the internal diameter 33 of the cap 5 in the region of the inner face 34 of the groove defined between the extensions 14 and 15, the retaining ring 16 is also braced in the radial direction in the cap 5, so that the seal can not, under any circumstances, be detached from the cap 5, if a needle is inserted through the seal 6 and is withdrawn therefrom.

If the external diameter 25 of the retaining ring 16 is greater than the internal diameter 33 of the cap 5, the shell 8, is expanded from the position shown in broken lines in FIG. 1 into the position shown in full lines therein, so as to be radially prestressed.

It is, however, sufficient if the external diameter 25 of the ring 16 corresponds to the internal diameter 33 of the cap 5.

The second embodiment of the invention will now be described with reference to FIGS. 3 and 4 in which parts identical with those described above bear the same reference numerals thereas. In this embodiment the cylindrical housing 3 is provided with guide extensions 35,36, which project from the outer circumference of the housing 3 at the open end face 2 thereof. The extensions 35,36 cooperate with guide cross-pieces 38 (only one of which is shown) on the internal face 37 of the cap 5 facing the housing 3 and project across the internal surface thereof. The other guide cross-piece 38 is arranged in the opposite part of the cap 5. The arrangement of the guide extensions 35,36 and of the guide cross-pieces 38 is such that when the cap 5 is pushed in the direction of the longitudinal axis 7, towards the open end face 2 of the housing 3 and is simultaneously twisted in a clockwise sense, the cross-pieces 38 run onto the extensions 35,36. By virtue of the simultaneous rotary and longitudinal movement of the cap 5, and of the guidance afforded by the guide cross-pieces 38, the cap 5 is pushed along the guide extensions 35,36 onto the housing 3. The exact function of the coupling device just described is described in detail in WO-A-89/09735 which is hereby incorporated herein by reference.

The guide means of FIG. 3 can be used in the closure means of FIGS. 1 and 2.

In order to prevent the seal 6 from twisting with respect to the cap 5, in particular in use of the coupling device described above between the cap 5 and the cylindrical housing 3, the retaining ring 16 may be provided with arresting elements 39, even if said coupling device is not provided, it is advantageous to provide the arresting elements 39, because rotational movement of the seal 6 can bring about loosening of the entire closure device 1.

As shown in FIG. 3, the arresting elements 39, which are in the form of teeth as shown in FIG. 3, press into the internal surface of the cap 5, especially if the plastic material thereof is not very hard, so that the ring 16 is firmly seated.

Additionally, in order to avoid relative rotation between the retaining ring 16 or the cap 5, and the seal 6, the ring 16 may be provided with spurs 40, which project towards the seal 6 and penetrate thereinto.

The surface of the ring 16 facing the seal 6 may be provided with corresponding roughened areas, which prevent rotation of the seal 6 which may be made of a soft rubber or of a silicone or the like. Also, the arresting elements 39 can be constituted by a milled edge or other roughened areas on the ring 16, instead of by the teeth shown, in order to fix the ring 16 in the cap 5.

Preferably where arresting elements 39 are provided, the external diameter 25 of the retaining ring 16 is greater than the internal diameter 33 of the groove defined between the extensions 14 and 15 of the cap 5. Penetration of the arresting elements 39 into the cap 5 is thereby assisted, and the cap 5 is correspondingly prestressed radially.

The seal 6 may be made of a composite material and may comprise a highly elastic internal core and an annular external sheath of greater rigidity than said internal core. The Shore hardness of the internal core may be 43°, the said sheath being substantially harder especially at the projection 17.

What is claimed is:

1. Closure means for use in closing an open end face of a cylindrical housing, said cylindrical housing having an interior with a surface, said closure means comprising an annular cap, said annular cap having a cylindrical inner surface, said cap having a cylindrical reception opening;

two extensions projecting toward a longitudinal axis of the annular cap along the cylindrical inner surface of said cap, a groove-shaped reception area defined by the inner surface between said extensions, said inner surface having a single diameter, said groove-shaped reception area having a substantially constant inner diameter;

a seal having a flange-like projection which engages within the groove-shaped reception area formed between said extensions, said flange-like projection being movably connected with said seal;

a retaining ring inserted between said seal and one of the two extensions;

said retaining ring having a greater external diameter than an internal diameter of at least one of said two extensions; and wherein, in use, said annular cap, said seal, said retaining ring and said extensions provide a coupling device which comprises one extension of the cap which is remote from the cylindrical housing and the other extension of the cap which is proximate to said end face of the housing, said flange-like projection on the seal being received in said groove-shaped reception area adjacent to said other extension, and said retaining ring being received in said groove-shaped reception area between said one extension and said flange-like projection.

2. Closure means as recited in claim 1, wherein said seal has said flange-like projection projecting from the seal and overhanging a cylindrical sealing face thereof in the region of an end face of the seal.

3. Closure means as recited in claim 1, wherein the internal diameter of said two extensions is smaller than the external diameter of said retaining ring.

4. Closure means as recited in claim 1, wherein the retaining ring is provided with arresting elements projecting towards a wall of the annular cap.

5. Closure means as recited in claim 1, wherein arresting elements projecting towards a wall of the annular cap are provided on a circumference of the retaining ring.

6. Closure means as recited in claim 1, wherein the extensions are arranged to be separated from each other along the direction of the longitudinal axis and extend perpendicular to this longitudinal axis.

7. Closure means as recited in claim 1, wherein said other extension is ring-shaped and adapted to be arranged on the end face of the cylindrical housing and a surrounding sealing face of the projection, which sealing face, in use, also faces the end face.

8. Closure means as recited in claim 1, wherein the height of the projection of said seal is greater in its relaxed, unmounted position in the direction of the longitudinal axis than the height of the groove-like recess between the extensions minus a thickness of the retaining ring.

9. Closure means as recited in claim 1, wherein said retaining ring is provided with spurs which project in the direction of said seal and penetrate thereinto.

10. Closure means as recited in claim 1, wherein the flange-like projection on the seal has an external diameter, and said retaining ring defines an opening which is of smaller diameter than the external diameter of the said flange-like projection on the seal.

11. Closure means as recited in claim 10, wherein said cylindrical housing has an internal diameter and said diameter of said opening of said retaining ring is intended to be smaller than the internal diameter of the cylindrical housing.

12. Closure means as recited in claim 1, wherein the seal is made of a composite material and has a highly elastic internal core and an annular external sheath of greater rigidity than said internal core.

13. Closure means as recited in claim 12, wherein said internal core has Shore hardness of 43°, said annular external sheath is of greater hardness than said core.

* * * * *